US006585322B1

(12) United States Patent
Lai

(10) Patent No.: US 6,585,322 B1
(45) Date of Patent: Jul. 1, 2003

(54) ARMREST ELEVATOR DEVICE

(76) Inventor: Yu-Shan Lai, 4F-3, No. 506, Freedom Rd., Gia Yi City (TW)

( * ) Notice: Subject to any disclaimer, the term of this patent is extended or adjusted under 35 U.S.C. 154(b) by 0 days.

(21) Appl. No.: 10/122,824

(22) Filed: Apr. 15, 2002

(51) Int. Cl.[7] ..... A47C 7/54
(52) U.S. Cl. ..... 297/411.36
(58) Field of Search ..... 297/411.36, 353, 297/410

(56) References Cited

U.S. PATENT DOCUMENTS 6,062,647 A * 5/2000 Mei ..... 297/411.36
6,394,553 B1 * 5/2002 McAllister et al. .... 297/411.36
6,398,309 B1 * 6/2002 Chen ..... 297/411.36

* cited by examiner

*Primary Examiner*—Anthony D. Barfield
(74) *Attorney, Agent, or Firm*—Alan D. Kamrath; Rider Bennett, LLP.

(57) ABSTRACT

An armrest elevator device has an armrest seat, an elevator plate, a movable block, a cover plate, a control button, a spring, and a pair of cylinder shafts. The elevator plate has a plurality of pairs of click grooves. The movable block has a top head having a round blind hole to receive the spring. The control button has a center recess. The armrest seat has a pair of rail sets, an oblong hole, an elongated groove, a pair of oblong apertures, and an oblong recess. The elevator plate is inserted in the armrest seat. The movable block is inserted in the elongated groove of the armrest seat. Each cylinder shaft is inserted in the corresponding oblong aperture of the armrest seat. The cover plate engages with the oblong hole of the armrest seat. The top head of the movable block is inserted through the cover plate and inserted in the center recess of the control button.

4 Claims, 5 Drawing Sheets

ARMREST ELEVATOR DEVICE

BACKGROUND OF THE INVENTION

The present invention relates to an armrest elevator device. More particularly, the present invention relates to an armrest elevator device which is easily operated.

Referring to FIG. 1, a conventional armrest elevator device has an elevator frame 100 having a groove 110, a panel 200 having an oblong recess 210, a click block 300 having a side recess 301, a spring 310, a flap plate 400, and a hollow oblong plate 500. The spring 310 is inserted in the side recess 301 of the click block 300. The click block 300, the flap plate 400 and the hollow oblong plate 500 are inserted in the oblong recess 210 of the panel 200. The panel 200 is inserted in the groove 110 of the elevator frame 100. Before the panel 200 is inserted in the groove 110 of the elevator frame 100, the spring 310, the click block 300, the flap plate 400 and the hollow oblong plate 500 are often ejected from the oblong recess 210 of the panel 200.

SUMMARY OF THE INVENTION

An object of the present invention is to provide an armrest elevator device which is easily operated.

Another object of the present invention is to provide an armrest elevator device which has an armrest seat and an elevator plate inserted in the armrest seat first so that other elements can be engaged with the elevator plate later in order to avoid an ejection of the other elements.

Accordingly, an armrest elevator device comprises an armrest seat, an elevator plate, a movable block, a cover plate, a control button, a spring, and a pair of cylinder shafts. The elevator plate has a plurality of pairs of click grooves. The movable block has a lower distal end and a top head having a plurality of circular apertures and a round blind hole to receive the spring. The cover plate has a through hole. The control button has a center recess and a pair of columns. The armrest seat has a pair of rail sets, an oblong hole, an elongated groove communicating with the oblong hole, a pair of oblong apertures communicating with the elongated groove, a plurality of oblong recesses, and a plurality of hollow posts. Each of the hollow posts has a round aperture. The elevator plate is inserted in the armrest seat along the rail sets. One of the pairs of the click grooves of the elevator plate matches the oblong apertures of the armrest seat. The movable block is inserted in the elongated groove of the armrest seat. Each of the cylinder shafts is inserted in the corresponding oblong aperture of the armrest seat. The cover plate engages with the oblong hole of the armrest seat. The top head of the movable block is inserted through the through hole of the cover plate and inserted in the center recess of the control button.

DETAILED DESCRIPTION OF THE INVENTION

Figure 1:
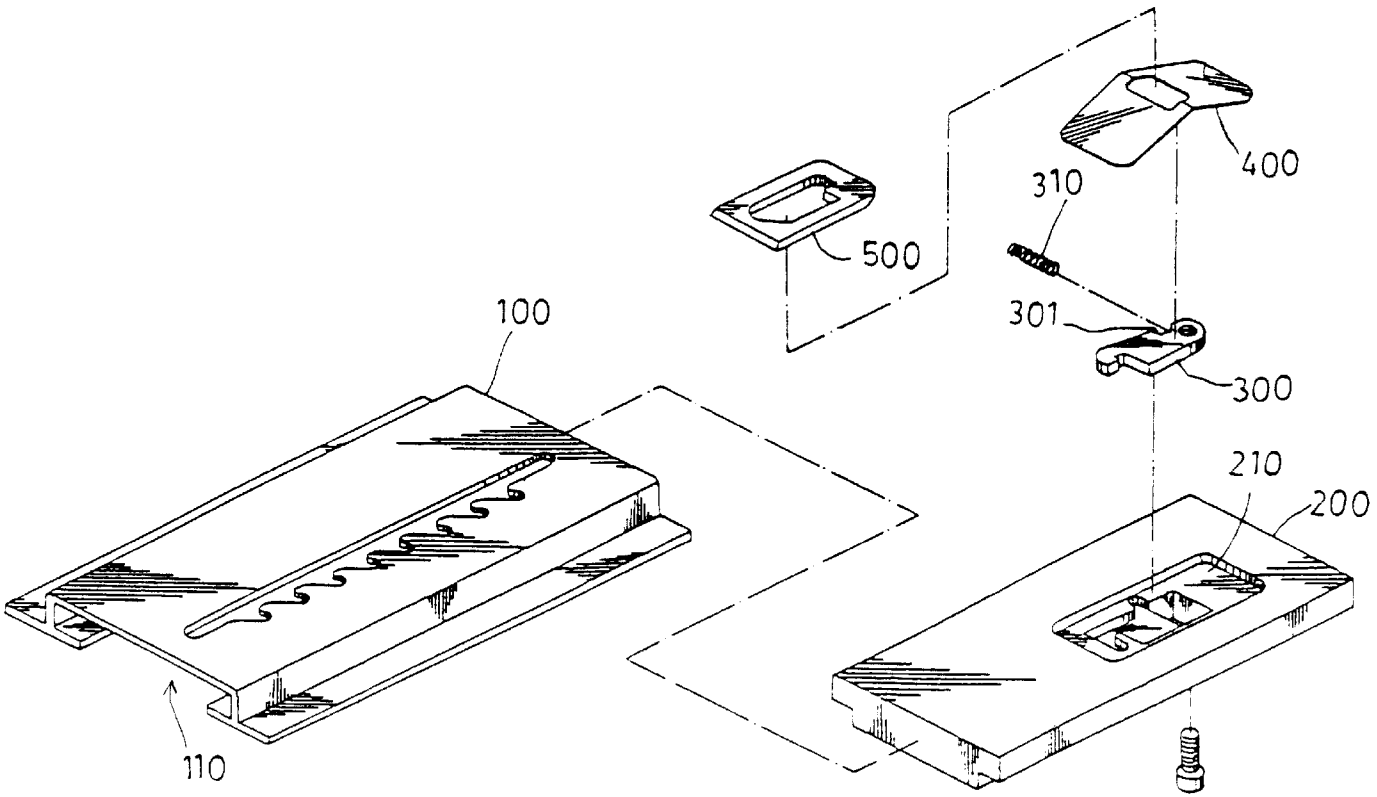
FIG. 1 PRIOR ART
FIG. 1 is a perspective exploded view of a conventional armrest elevator device of the prior art.
Figure 2:
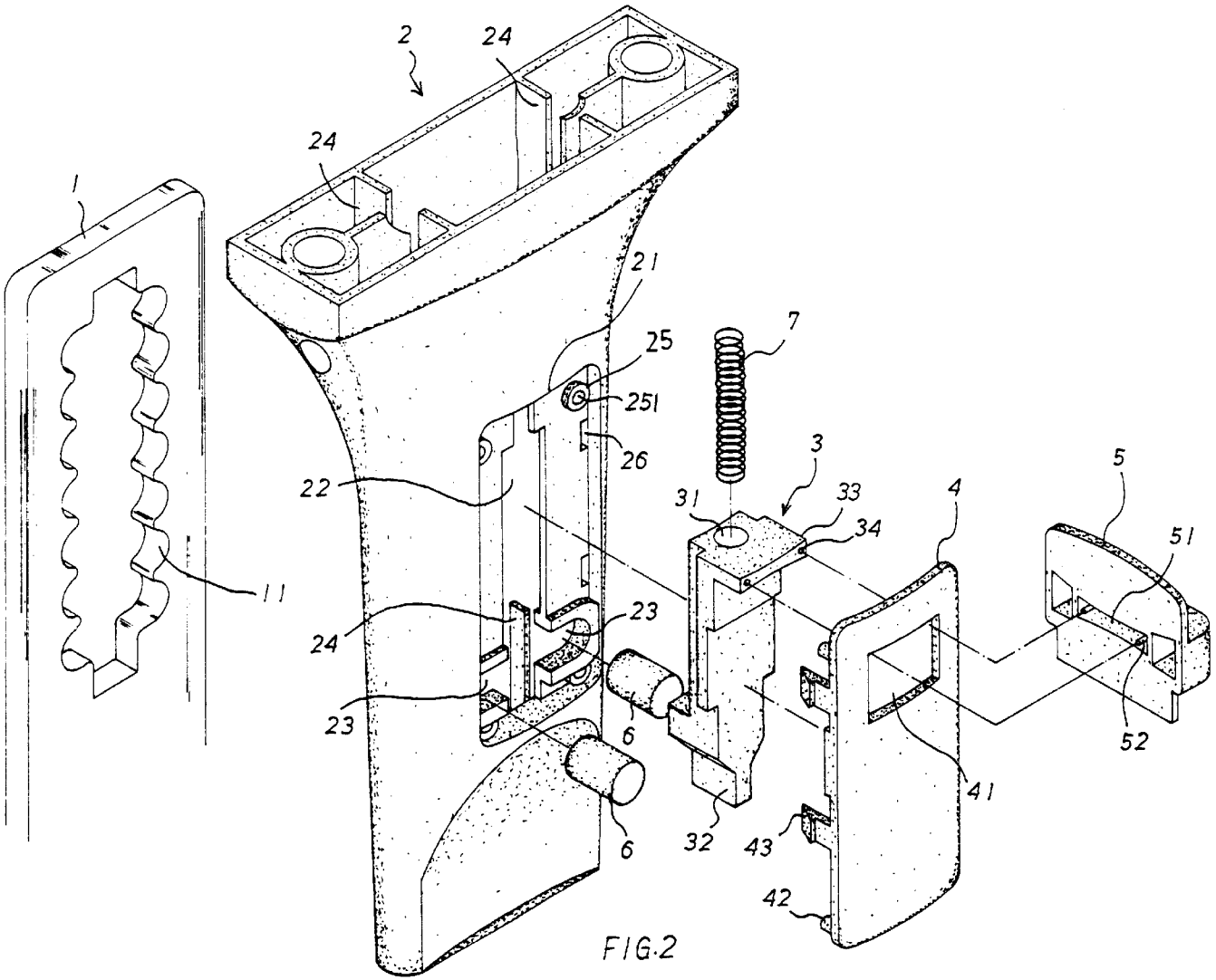
FIG. 2 is a perspective exploded view of an armrest elevator device of a preferred embodiment in accordance with the present invention.
Figure 3:
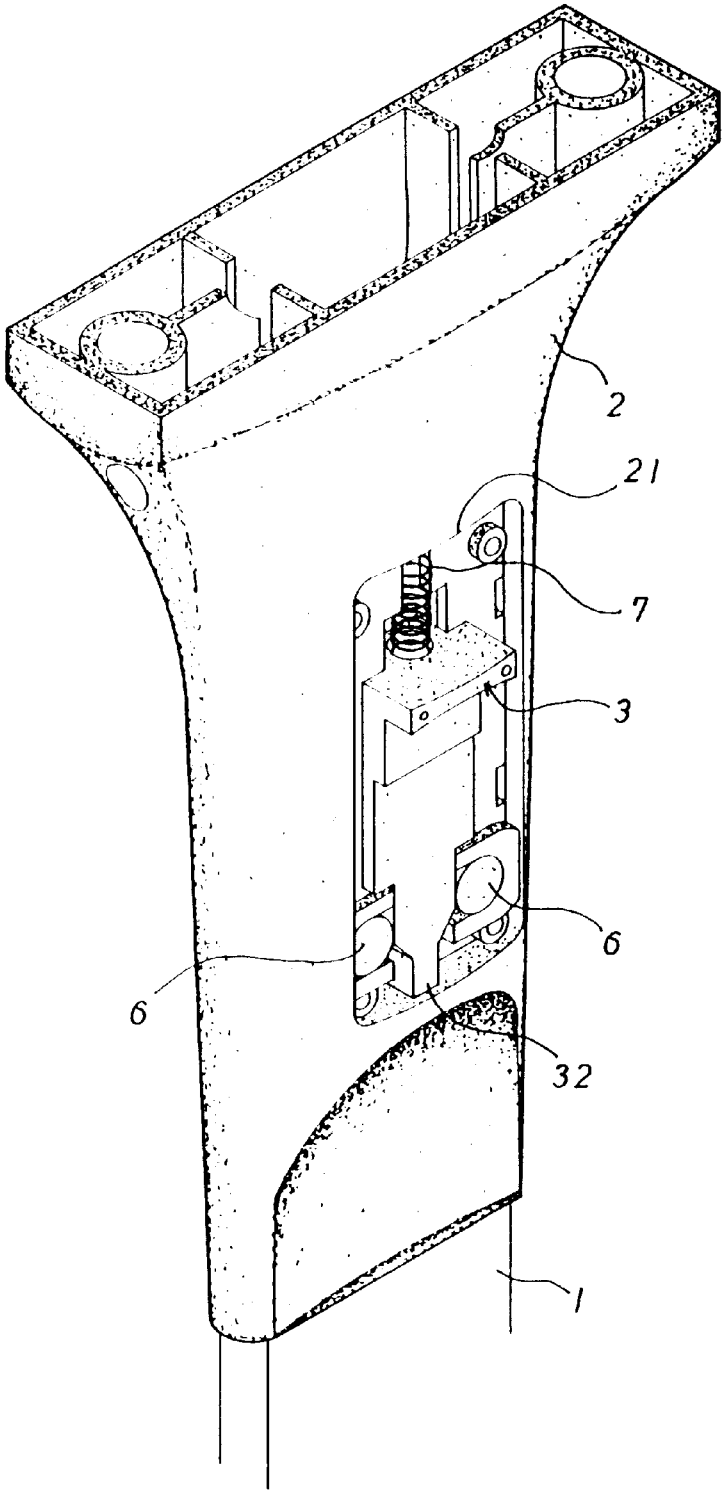
FIG. 3 is a perspective assembly view of an armrest elevator device of a preferred embodiment without a cover plate and a control button.
Figure 4:
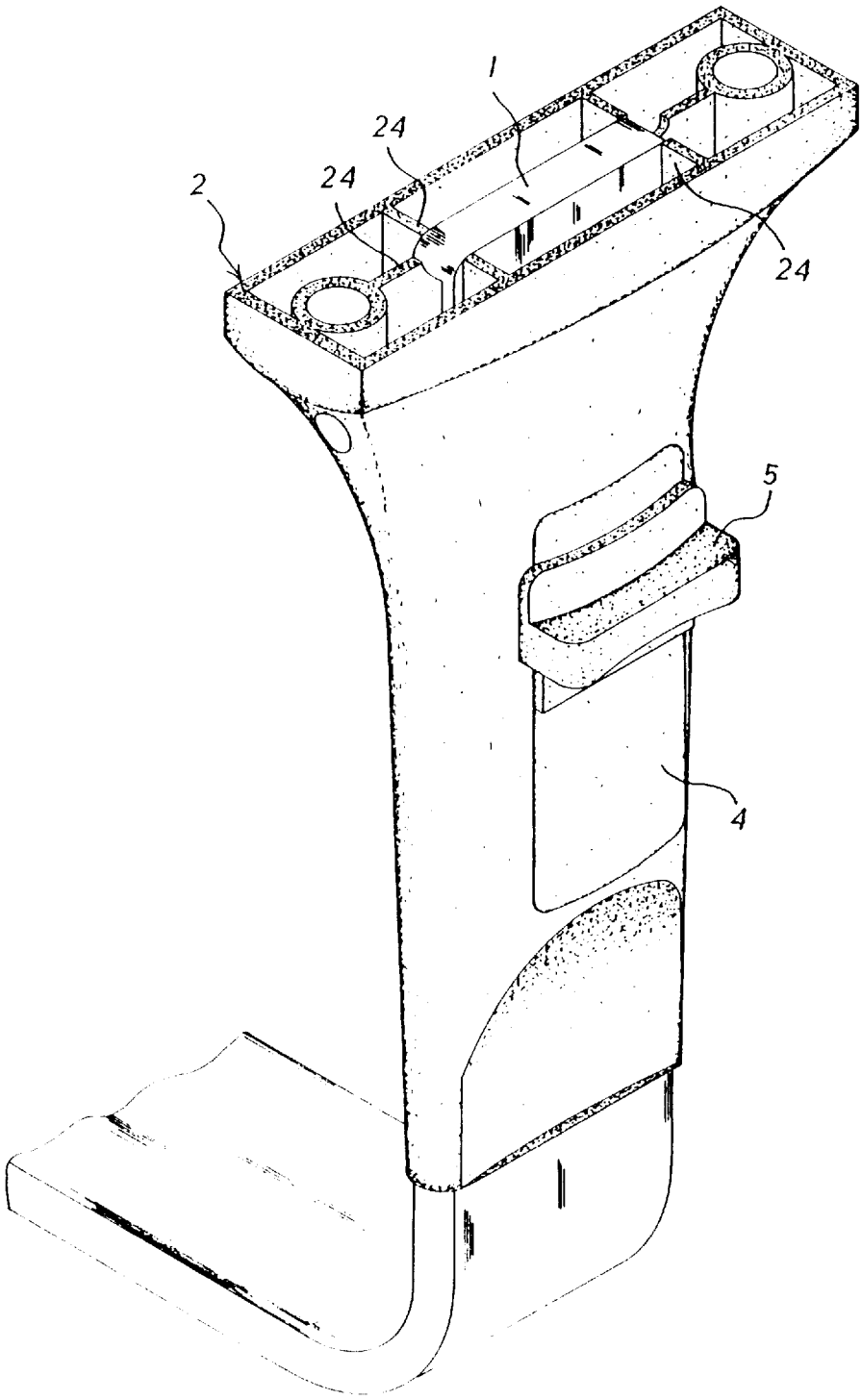
FIG. 4 is a perspective assembly view of an armrest elevator device of a preferred embodiment in accordance with the present invention.
Figure 6:
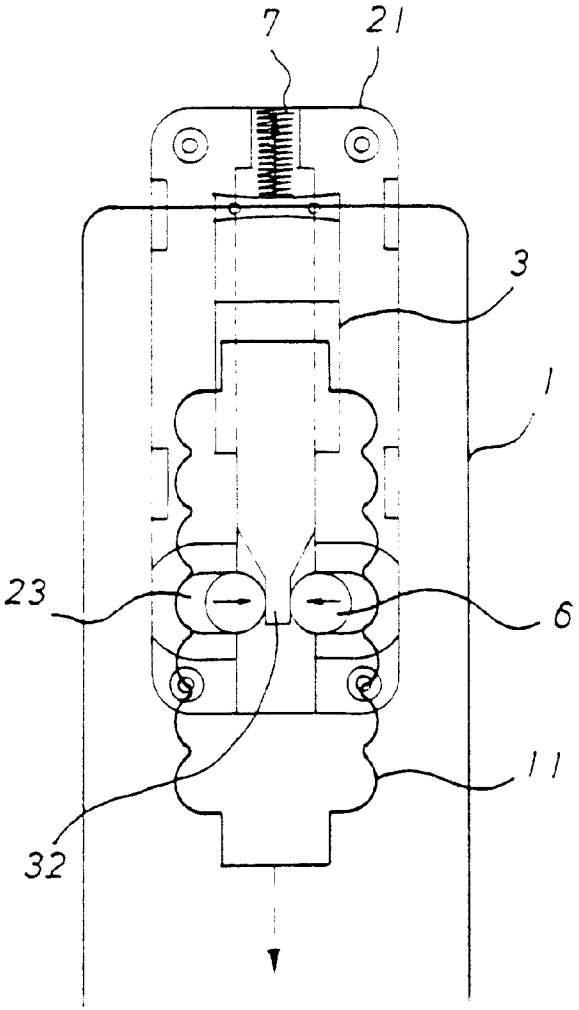
FIG. 6 is a schematic view illustrating a second operation of an armrest elevator device of a preferred embodiment in accordance with the present invention.
Figure 5:
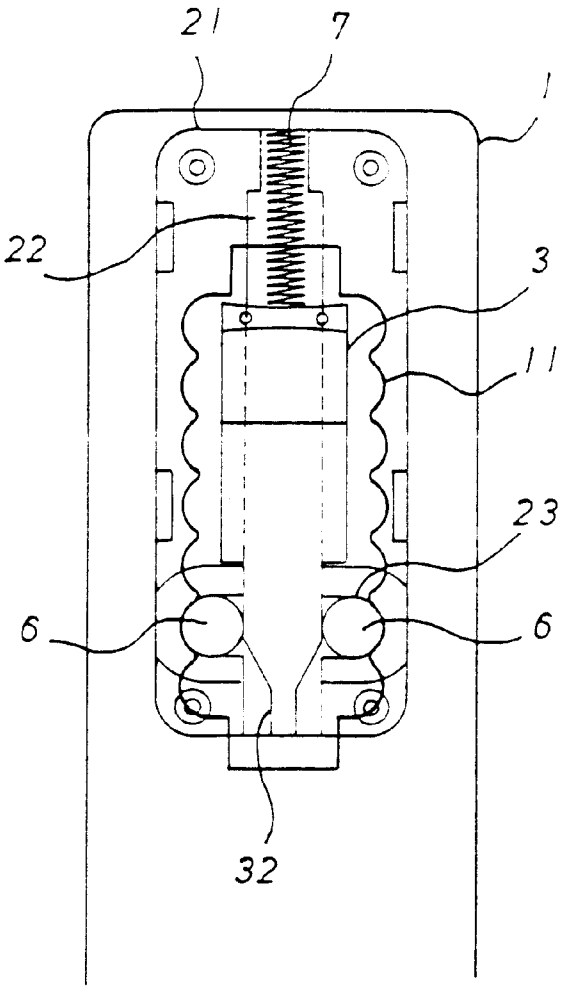
FIG. 5 is a schematic view illustrating a first operation of an armrest elevator device of a preferred embodiment in accordance with the present invention.

Referring to FIGS. 2 to 6, an armrest elevator device comprises an armrest seat 2, an elevator plate 1, a movable block 3, a cover plate 4, a control button 5, a spring 7, and a pair of cylinder shafts 6.

The elevator plate 1 has a plurality of pairs of click grooves 11.

The movable block 3 has a lower distal end 32 and a top head 33 having a plurality of circular apertures 34 and a round blind hole 31 to receive the spring 7.

The cover plate 4 has a through hole 41, a plurality of hooks 43, and a plurality of connection rods 42.

The control button 5 has a center recess 51 and a pair of columns 52.

The armrest seat 2 has a pair of rail sets 24, an oblong hole 21, an elongated groove 22 communicating with the oblong hole 21, a pair of oblong apertures 23 communicating with the elongated groove 22, a plurality of oblong recesses 26, and a plurality of hollow posts 25.

Each of the hollow posts 25 has a round aperture 251.

The elevator plate 1 is inserted in the armrest seat 2 along the rail sets 24.

One of the pairs of the click grooves 11 of the elevator plate 1 matches the oblong apertures 23 of the armrest seat 2.

The movable block 3 is inserted in the elongated groove 22 of the armrest seat 2.

Each of the cylinder shafts 6 is inserted in the corresponding oblong aperture 23 of the armrest seat 2.

The cover plate 4 engages with the oblong hole 21 of the armrest seat 2.

The top head 33 of the movable block 3 is inserted through the through hole 41 of the cover plate 4 and inserted in the center recess 51 of the control button 5.

Each of the hooks 43 is inserted in the corresponding oblong recess 26 of the armrest seat 2.

Each of the connection rods 42 is inserted in the corresponding hollow post 25.

Since the spring 7 is disposed between the armrest seat 2 and the top head 33 of the movable block 3, the movable block 3 is often pressed downward.

When the movable block 3 is moved upward, the spring 7 is compressed. Then each of the cylinder shafts 6 disengages from the corresponding oblong aperture 23 of the armrest seat 2.

An adhesive (not shown in the figures) is disposed between the cover plate 4 and the control button 5.

The invention is not limited to the above embodiment but various modification thereof may be made. Further, various changes in form and detail may be made without departing from the scope of the invention.

I claim:

1. An armrest elevator device comprises:

an armrest seat, an elevator plate, a movable block, a cover plate, a control button, a spring, and a pair of cylinder shafts, the elevator plate having a plurality of pairs of click grooves, the movable block having a lower distal end and a top head having a plurality of circular apertures and a round blind hole to receive the spring, the cover plate having a through hole, the control button having a center recess and a pair of columns, the armrest seat having a pair of rail sets, an oblong hole, an elongated groove communicating with the oblong hole, a pair of oblong apertures communicating with the elongated groove, a plurality of oblong recesses, and a plurality of hollow posts, each of the hollow posts having a round aperture, the elevator plate inserted in the armrest seat along the rail sets, one of the pairs of the click grooves of the elevator plate matching the oblong apertures of the armrest seat, the movable block inserted in the elongated groove of the armrest seat, each of the cylinder shafts inserted in the corresponding oblong aperture of the armrest seat, the cover plate engaging with the oblong hole of the armrest seat, and the top head of the movable block inserted through the through hole of the cover plate and inserted in the center recess of the control button.

2. The armrest elevator device as claimed in claim 1, wherein the cover plate further has a plurality of hooks and each of the hooks is inserted in the corresponding oblong recess of the armrest seat.

3. The armrest elevator device as claimed in claim 1, wherein the cover plate further has a plurality of connection rods and each of the connection rods is inserted in the corresponding hollow post.

4. The armrest elevator device as claimed in claim 1, wherein an adhesive is disposed between the cover plate and the control button.

* * * * *